US010522930B2

(12) United States Patent
Farkas et al.

(10) Patent No.: US 10,522,930 B2
(45) Date of Patent: Dec. 31, 2019

(54) SYSTEMS AND METHODS FOR FREQUENCY SHIFTING RESONANCE OF CONNECTOR STUBS

(71) Applicant: Dell Products L.P., Round Rock, TX (US)

(72) Inventors: Sandor Farkas, Round Rock, TX (US); Bhyrav M. Mutnury, Round Rock, TX (US); Raymond Dewine Heistand, II, Round Rock, TX (US)

(73) Assignee: Dell Products L.P., Round Rock, TX (US)

( * ) Notice: Subject to any disclaimer, the term of this patent is extended or adjusted under 35 U.S.C. 154(b) by 449 days.

(21) Appl. No.: 15/068,143

(22) Filed: Mar. 11, 2016

(65) Prior Publication Data

US 2017/0264040 A1 Sep. 14, 2017

(51) Int. Cl.

| | |
|---|---|
| ***H01R 13/28*** | (2006.01) |
| ***H01R 13/26*** | (2006.01) |
| ***H01R 43/16*** | (2006.01) |
| ***H01R 43/20*** | (2006.01) |

(52) U.S. Cl.

CPC ..... *H01R 13/28* (2013.01); *H01R 13/26* (2013.01); *H01R 43/16* (2013.01); *H01R 43/20* (2013.01)

(58) Field of Classification Search

CPC ..... H01R 13/26; H01R 13/28; H01R 43/16; H01R 43/20; H01R 23/27; H01R 24/84

USPC ..... 439/733.1, 290, 862, 284, 295

See application file for complete search history.

(56) References Cited

U.S. PATENT DOCUMENTS 741,052 A * 10/1903 Mahon ..... H01R 13/28 200/51.1
937,052 A * 10/1909 Cuno ..... H01R 11/281 439/429
1,531,917 A * 3/1925 French ..... H01H 1/46 200/258
1,911,395 A * 5/1933 Rowley ..... H01R 13/20 439/263
1,975,999 A * 10/1934 Young ..... H01T 13/04 439/838
2,221,280 A * 11/1940 Woodside ..... H01R 13/71 200/51 R
2,319,122 A * 5/1943 Funk ..... H01R 13/20 439/708
3,171,183 A * 3/1965 Johnston ..... A01K 27/005 24/635
3,366,915 A * 1/1968 Miller ..... H01R 13/28 439/284
3,675,187 A * 7/1972 Christman ..... H01R 13/20 439/596

(Continued)

FOREIGN PATENT DOCUMENTS

EP 0084318 A2 7/1983

*Primary Examiner* — Travis S Chambers
(74) *Attorney, Agent, or Firm* — Jackson Walker L.L.P.

(57) ABSTRACT

In accordance with embodiments of the present disclosure, a connector may include a housing and an electrically-conductive pin housed in the housing and configured to electrically couple to a corresponding electrically-conductive conduit of an information handling resource comprising the connector. The pin may include a beam extending from the housing and a stub terminating the pin, the stub having a per-unit-length surface area greater than that of the beam.

12 Claims, 7 Drawing Sheets

(56) References Cited

U.S. PATENT DOCUMENTS 3,676,838 A * 7/1972 Hartz ..... H01R 13/20 439/749
3,848,948 A * 11/1974 Soes ..... H01R 13/193 439/252
4,241,381 A * 12/1980 Cobaugh ..... H05K 7/1457 361/624
4,335,931 A * 6/1982 Kinnear ..... H01R 13/28 439/295
4,842,536 A * 6/1989 Meyrat ..... H01R 13/052 439/246
4,923,414 A 5/1990 Sitzler
5,074,215 A * 12/1991 Fiala ..... F41A 19/69 102/293
5,188,544 A * 2/1993 Mukai ..... H01R 11/12 439/287
5,634,829 A * 6/1997 Kerul ..... H01R 13/193 439/842
5,689,242 A * 11/1997 Sims ..... G08B 13/1409 340/568.3
5,865,638 A * 2/1999 Trafton ..... H01R 11/12 439/288
6,231,394 B1 * 5/2001 Schnell ..... G06K 7/0021 439/630
6,276,941 B1 * 8/2001 Wu ..... H01R 13/2442 439/515
6,398,598 B2 * 6/2002 Masumoto ..... H01R 13/2442 439/862
6,447,338 B1 * 9/2002 Bricaud ..... G06K 7/0021 439/630
6,540,529 B1 * 4/2003 Yu ..... H01R 24/84 439/74
6,994,566 B2 * 2/2006 You ..... H01R 13/2442 439/66
7,001,194 B2 * 2/2006 Yang ..... H01R 13/28 439/295
7,249,981 B2 7/2007 Chen
7,377,823 B2 5/2008 Chen
7,914,330 B2 * 3/2011 Su ..... H01R 13/50 439/607.31
8,172,625 B2 * 5/2012 Kashiwada ..... H01R 4/184 439/8
8,668,529 B2 * 3/2014 Park ..... H01R 12/714 439/700
8,911,242 B2 * 12/2014 Jeon ..... H01R 13/2442 439/66
9,431,733 B1 8/2016 Heistand et al.
2008/0268690 A1 * 10/2008 Lu ..... H01R 13/2442 439/345
2010/0081342 A1 * 4/2010 Nikaido ..... H01L 23/49827 439/709
2015/0099376 A1 * 4/2015 Hashiguchi ..... H01R 12/714 439/66
2015/0132997 A1 * 5/2015 Mitsuno ..... H01R 24/50 439/675
2015/0295329 A1 * 10/2015 Oguro ..... H01R 13/2442 439/676
2017/0077627 A1 * 3/2017 Matsumoto ..... H01R 12/585

* cited by examiner

SYSTEMS AND METHODS FOR FREQUENCY SHIFTING RESONANCE OF CONNECTOR STUBS

TECHNICAL FIELD

The present disclosure relates in general to information handling systems, and more particularly to a system and method for frequency shifting resonance of an unused mating stub in a connector.

BACKGROUND

As the value and use of information continues to increase, individuals and businesses seek additional ways to process and store information. One option available to users is information handling systems. An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

An information handling system may include one or more circuit boards operable to mechanically support and electrically couple electronic components making up the information handling system. For example, circuit boards may be used as part of motherboards, memories, storage devices, storage device controllers, peripherals, peripheral cards, network interface cards, and/or other electronic components. As is known in the art, a circuit board may comprise a plurality of conductive layers separated and supported by layers of insulating material laminated together, with conductive traces disposed on and/or in any of such conductive layers. As is also known in the art, connectivity between conductive traces disposed on and/or in various layers of a circuit board may be provided by conductive vias.

To electrically couple circuit boards together or to couple a circuit board to a cable comprising electrically conductive wires, electrical connectors may be used. One type of mating between connectors may be referred to as a mating blade architecture, depicted in FIGS. 1A and 1B. In a mating blade architecture, a first connector 10 may comprise a housing 12 (e.g., constructed of plastic or other suitable material) which houses one or more blade pins 14 electrically coupled via the connector to corresponding electrically-conductive conduits (e.g., wires of a cable or vias/traces of a circuit board). A second connector 16 of the mating blade architecture may include a housing 18 (e.g., constructed of plastic or other suitable material) which houses one or more beam pins 20. To couple first connector 10 and second connector 16, a force may be applied to one or both of first connector 10 and second connector 16 in the direction of the double-ended arrow shown in FIG. 1A, such that each blade pin 14 slides under the upwardly-curving portion of a corresponding beam pin 20, to electrically couple each blade pin 14 to its corresponding beam pin 20 at a contact point 22 as shown in FIG. 1B.

As a result of the coupling between a blade pin 14 and its corresponding beam pin 20, portions of each of blade pin 14 and beam pin 20 may be "unused" in the sense that such portions are present but not needed to conduct a signal between blade pin 14 and beam pin 20. Rather, such portions are present to create mechanical features ensuring the physical mating of connectors 10 and 16. For example, as can be seen from FIG. 1B, blade pin 14 may have an unused portion or "stub" 24 which is not part of an electrically conductive path between blade pin 14 and beam pin 20, and beam pin 20 may also have an unused portion or stub 26 which is not part of an electrically conductive path between blade pin 14 and beam pin 20.

Each stub 24 and 26 may act as an antenna, and thus may resonate at frequencies (and harmonics thereof) for which the length of such stub 24 or 26 is equal to one-quarter of the wavelength of such frequencies. As transmission frequencies used in the communication pathways of information handling systems increase, signals operating at such frequencies may be affected by such resonances, resulting in decreased signal integrity.

Some approaches may be employed to mitigate the effect of stub resonances, but such approaches still have disadvantages. For example, an alternative to the mating blade architecture, and known as a mating beam architecture, is depicted in FIGS. 2A and 2B. In a mating beam architecture, a first connector 30 may comprise a housing 32 (e.g., constructed of plastic or other suitable material) which houses one or more first beam pins 34 electrically coupled via the connector to corresponding electrically-conductive conduits (e.g., wires of a cable or vias/traces of a circuit board). A second connector 36 of the mating beam architecture may include a housing 38 (e.g., constructed of plastic or other suitable material) which houses one or more second beam pins 40. To couple first connector 30 and second connector 36, a force may be applied to one or both of first connector 30 and second connector 36 in the direction of the double-ended arrow shown in FIG. 2A, such that each first beam pin 34 slides under the upwardly-curving portion of a corresponding second beam pin 40, to electrically couple each first beam pin 34 to its corresponding second beam pin 40 at a contact point 42 as shown in FIG. 2B. While this architecture may eliminate the mating blade stub of one connector, this architecture still includes two stubs 44 and 46 which may cause undesirable resonances.

SUMMARY

In accordance with the teachings of the present disclosure, the disadvantages and problems associated with resonance in connector stubs have been reduced or eliminated.

In accordance with embodiments of the present disclosure, a connector may include a housing and an electrically-conductive pin housed in the housing and configured to electrically couple to a corresponding electrically-conductive conduit of an information handling resource comprising the connector. The pin may include a beam extending from the housing and a stub terminating the pin, the stub having a per-unit-length surface area greater than that of the beam.

In accordance with these and other embodiments of the present disclosure, an information handling system may include an information handling resource and a connector coupled to the information handling resource. The connector may include a housing and an electrically-conductive pin housed in the housing and configured to electrically couple to a corresponding electrically-conductive conduit of an information handling resource comprising the connector. The pin may include a beam extending from the housing and a stub terminating the pin, the stub having a per-unit-length surface area greater than that of the beam.

In accordance with these and other embodiments of the present disclosure, a method for forming an electrically-conductive pin for a connector may include providing a beam of the pin and terminating the beam with a stub having a per-unit-length surface area greater than that of the beam.

Technical advantages of the present disclosure may be readily apparent to one skilled in the art from the figures, description and claims included herein. The objects and advantages of the embodiments will be realized and achieved at least by the elements, features, and combinations particularly pointed out in the claims.

It is to be understood that both the foregoing general description and the following detailed description are examples and explanatory and are not restrictive of the claims set forth in this disclosure.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION

Figure 1A:
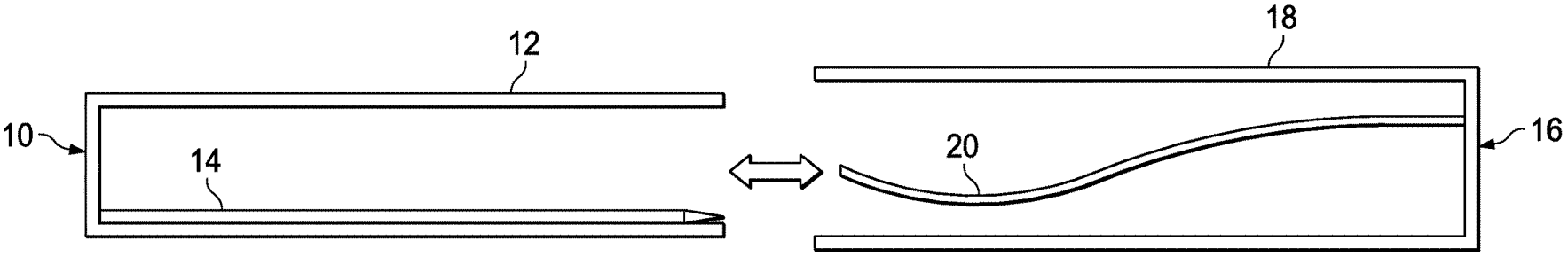
FIG. 1A (PRIOR ART)
FIGS. 1A and 1B each illustrate a cross-sectional elevation view of selected components of connectors for use in a mating blade architecture, as is known in the art.
Figure 1B:
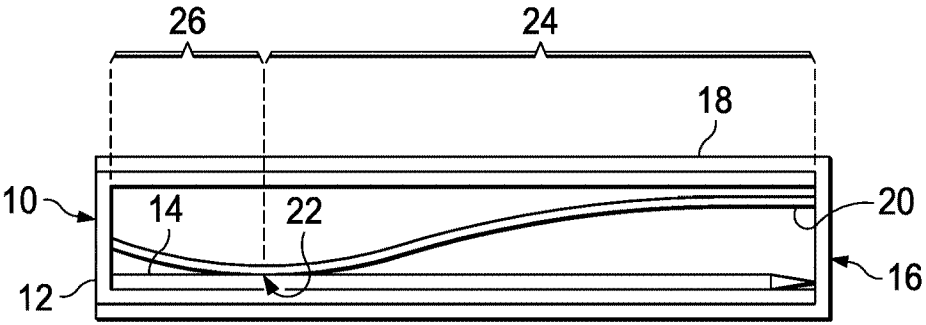
FIG. 1B (PRIOR ART)

Preferred embodiments and their advantages are best understood by reference to FIGS. 3A through 8, wherein like numbers are used to indicate like and corresponding parts.

For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communicating with external devices as well as various input and output (I/O) devices, such as a keyboard, a mouse, and a video display. The information handling system may also include one or more buses operable to transmit communications between the various hardware components.

For the purposes of this disclosure, computer-readable media may include any instrumentality or aggregation of instrumentalities that may retain data and/or instructions for a period of time. Computer-readable media may include, without limitation, storage media such as a direct access storage device (e.g., a hard disk drive or floppy disk), a sequential access storage device (e.g., a tape disk drive), compact disk, CD-ROM, DVD, random access memory (RAM), read-only memory (ROM), electrically erasable programmable read-only memory (EEPROM), and/or flash memory; as well as communications media such as wires, optical fibers, microwaves, radio waves, and other electromagnetic and/or optical carriers; and/or any combination of the foregoing.

For the purposes of this disclosure, information handling resources may broadly refer to any component system, device or apparatus of an information handling system, including without limitation processors, service processors, basic input/output systems, buses, memories, I/O devices and/or interfaces, storage resources, network interfaces, motherboards, and/or any other components and/or elements of an information handling system.

As discussed above, an information handling system may include one or more circuit boards operable to mechanically support and electrically connect electronic components making up the information handling system (e.g., packaged integrated circuits). Circuit boards may be used as part of motherboards, memories, storage devices, storage device controllers, peripherals, peripheral cards, network interface cards, and/or other electronic components. As used herein, the term "circuit board" includes printed circuit boards (PCBs), printed wiring boards (PWBs), etched wiring boards, and/or any other board or similar physical structure operable to mechanically support and electrically couple electronic components.

Figure 3A:
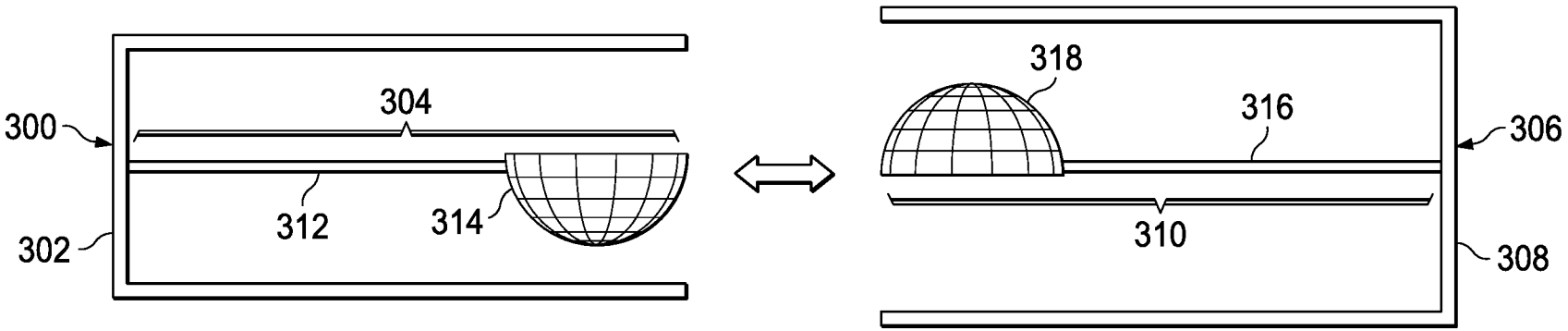
FIG. 3A illustrates a cross-sectional elevation view of selected components of corresponding mating beam-type connectors depicting beam pins with hemispheroidal stubs, in accordance with embodiments of the present disclosure.
Figure 3B:
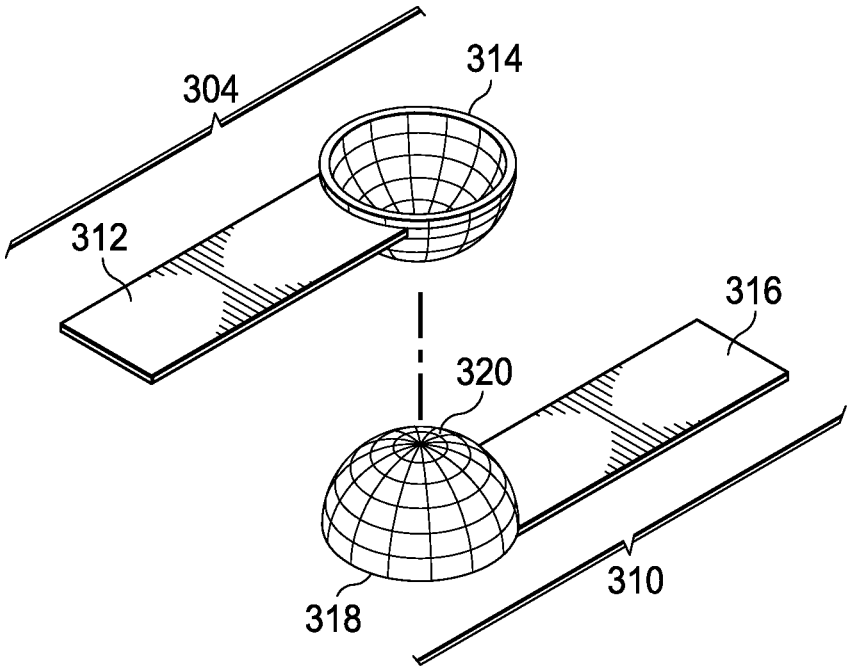
FIGS. 3B and 3C each illustrate an isometric view of pins of the mating beam-type connectors depicted in FIG. 3A, in accordance with embodiments of the present disclosure.
Figure 3C:
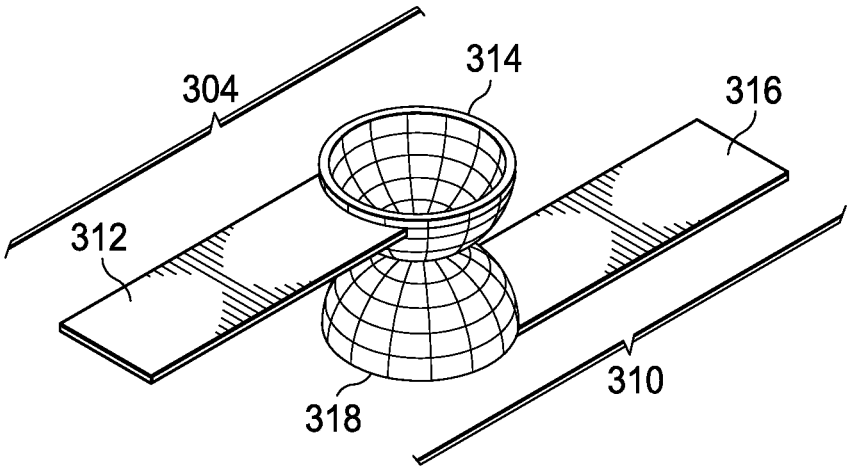

FIG. 3A illustrates a cross-sectional elevation view of selected components of mating beam-type connectors 300 and 306 and FIGS. 3B and 3C each illustrate an isometric view of beam pins 304 and 310 of the mating beam-type connectors depicted in FIG. 3A, in accordance with embodiments of the present disclosure. As shown in FIG. 3A, connector 300 may comprise a housing 302 (e.g., constructed of plastic or other suitable material) which houses one or more beam pins 304 electrically coupled via the connector to corresponding electrically-conductive conduits (e.g., wires of a cable or vias/traces of a circuit board). Each beam pin 304 may comprise an electrically-conductive material (e.g., aluminum, copper, silver, gold, or other metal) comprising a beam 312 extending from housing 302, beam 312 terminated with a hemispheroidal stub 314. Similarly, connector 306 may comprise a housing 308 (e.g., constructed of plastic or other suitable material) which houses one or more beam pins 310 electrically coupled via the connector to corresponding electrically-conductive conduits (e.g., wires of a cable or vias/traces of a circuit board). Each beam pin 310 may comprise an electrically-conductive material (e.g., aluminum, copper, silver, gold, or other metal) comprising a beam 316 extending from housing 308, beam 316 terminated with a hemispheroidal stub 318. In some embodiments, beam pin 304 may be coupled to housing 302 in a manner such that a spring force exists between beam pin 304 and housing 302 such that beam pin 304 is biased in a downward direction with respect to the depiction in FIG. 3A. In addition or alternatively, beam pin 310 may be coupled to housing 308 in a manner such that a spring force exists between beam pin 310 and housing 308 such that beam pin 310 is biased in an upward direction with respect to the depiction in FIG. 3A. Such spring forces may aid in mechanical retention and/or electrical coupling between beam pins 304 and 310 when connector 300 is engaged with connector 306.

Accordingly, when connector 300 is engaged with connector 306, the convex surface of hemispheroidal stub 314 may be in physical contact with the convex surface of hemispheroidal stub 318, thus providing electrical connectivity between beam pin 304 and beam pin 310. As shown in FIG. 3B, hemispheroidal stub 318 may include an indent 320 or other mechanical feature near the apex of the convex surface of hemispheroidal stub 318, to aid in retention of hemispheroidal stub 314 with respect to hemispheroidal stub 318 when connectors 300 and 306 are engaged with one another as shown in FIG. 3C.

Although FIGS. 3A-3C depict beam pins 304 and 310 having hemispheroidal stubs 314 and 318 that electrically coupled to each other via the convex surfaces of each, numerous other types of beam pins and electrical couplings between beam pins may be made consistent with this disclosure.

Figure 4A:
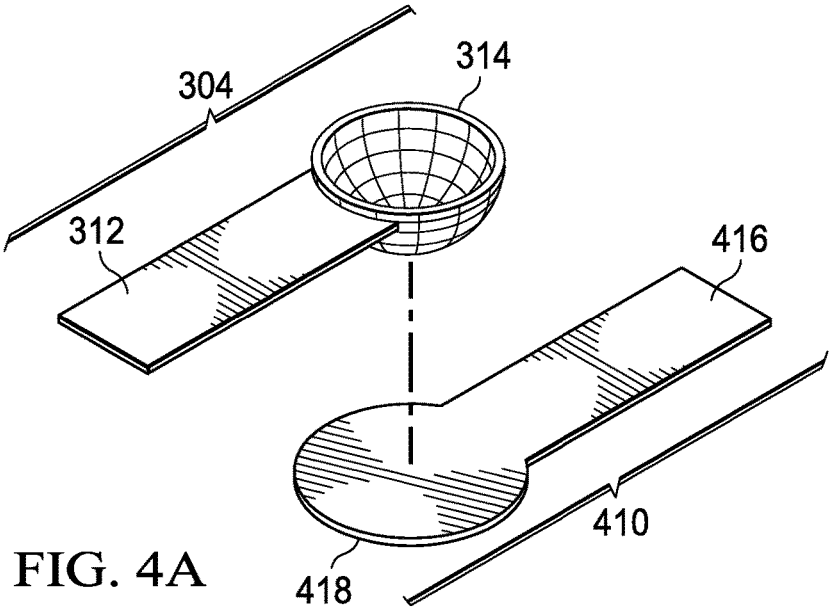
FIGS. 4A and 4B each illustrate an isometric view of selected components of corresponding mating beam-type connectors depicting a beam pin with a hemispheroidal stub and a beam pin with an elliptical stub, in accordance with embodiments of the present disclosure.
Figure 4B:
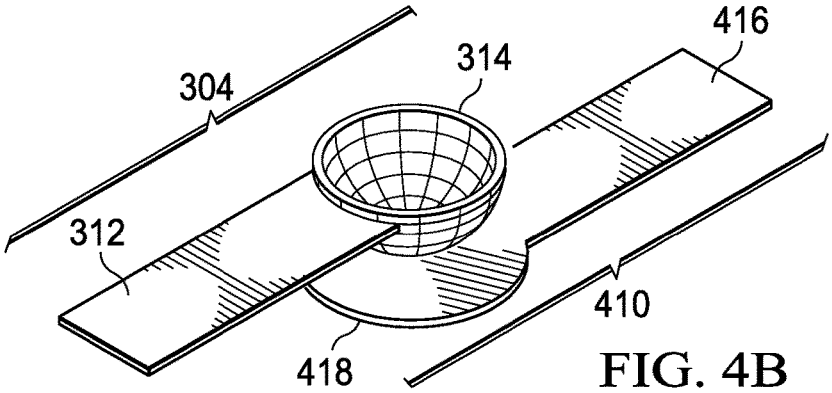

For example, FIGS. 4A and 4B each illustrate an isometric view of selected components of corresponding mating beam-type connectors depicting a beam pin 304 with a hemispheroidal stub 314 (e.g., as shown in FIGS. 3A-3C) and a beam pin 410 with an elliptical stub 418, in accordance with embodiments of the present disclosure. In some embodiments, beam pins 410 may be used in connector 306 in lieu of beam pins 310. Each beam pin 410 may comprise an electrically-conductive material (e.g., aluminum, copper, silver, gold, or other metal) comprising a beam 416 extending from a housing (e.g., housing 308), beam 416 terminated with an elliptical (e.g., circular) stub 418. The elliptical stub 418 may share a dimension in common with beam 416 (e.g., height) while being larger in size with respect to at least one other dimension (e.g., width), allowing for a large contact area for electrically coupling to the convex surface of hemispheroidal stub 314 of beam pin 304. When a connector housing beam pin 304 is engaged with connector housing beam pin 410, the convex surface of hemispheroidal stub 314 may be in physical contact with a surface of elliptical stub 418, thus providing electrical connectivity between beam pin 304 and beam pin 410, as shown in FIG. 4B.

Figure 5A:
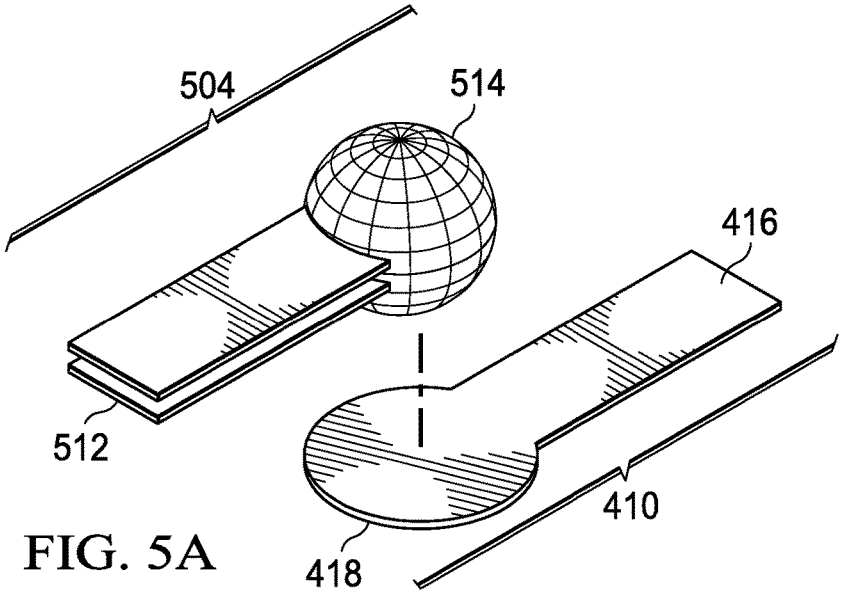
FIGS. 5A and 5B each illustrate an isometric view of selected components of corresponding mating beam-type connectors depicting a beam pin with a spheroidal stub and a beam pin with an elliptical stub, in accordance with embodiments of the present disclosure.
Figure 5B:
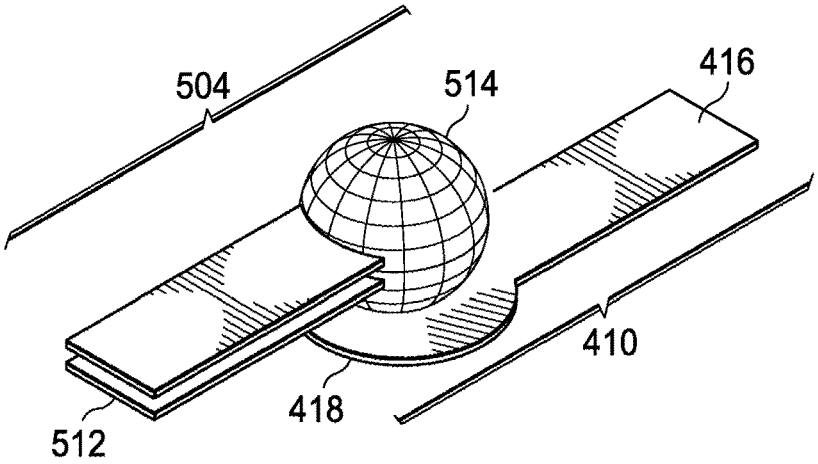

FIGS. 5A and 5B each illustrate an isometric view of selected components of corresponding mating beam-type connectors depicting a beam pin 504 with a spheroidal stub 514 and a beam pin 410 with an elliptical stub 418 (e.g., as shown in FIGS. 4A and 4B), in accordance with embodiments of the present disclosure. In some embodiments, beam pins 504 may be used in connector 300 in lieu of beam pins 304. Each beam pin 504 may comprise an electrically-conductive material (e.g., aluminum, copper, silver, gold, or other metal) comprising a beam 512 extending from a housing (e.g., housing 302), beam 512 terminated with a spheroidal stub 514. When a connector housing beam pin 504 is engaged with connector housing beam pin 410, the convex surface of spheroidal stub 514 may be in physical contact with a surface of elliptical stub 418, thus providing electrical connectivity between beam pin 504 and beam pin 410, as shown in FIG. 5B.

Figure 6A:
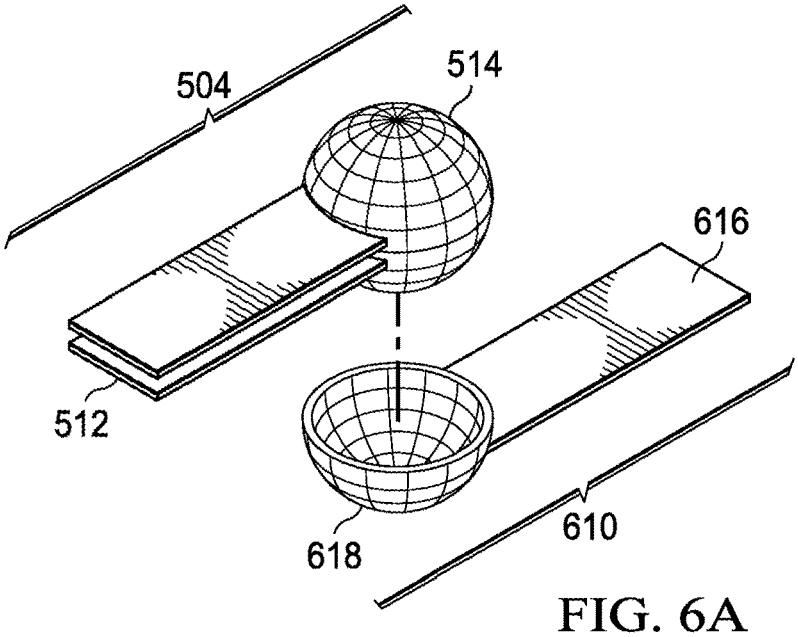
FIGS. 6A and 6B each illustrate an isometric view of selected components of corresponding mating beam-type connectors depicting a beam pin with a spheroidal stub and a beam pin with a hemispheroidal stub, in accordance with embodiments of the present disclosure.
Figure 6B:
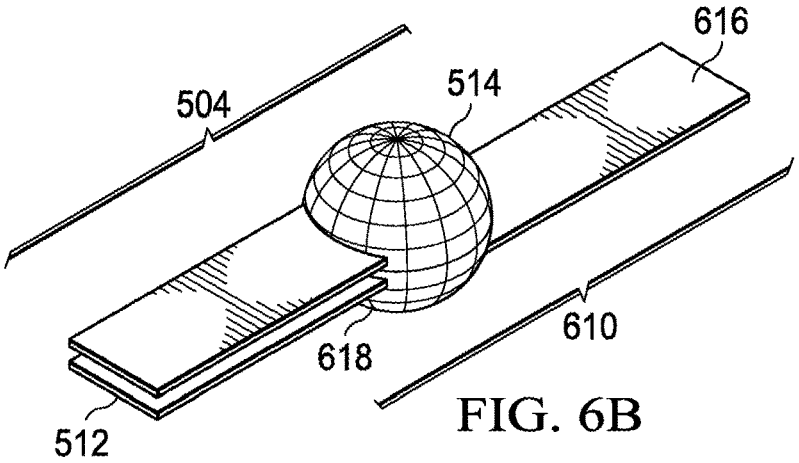

FIGS. 6A and 6B each illustrate an isometric view of selected components of corresponding mating beam-type connectors depicting a beam pin 504 with a spheroidal stub 514 (e.g., as shown in FIGS. 5A and 5B) and a beam pin 610 with a hemispheroidal stub 618, in accordance with embodiments of the present disclosure. In some embodiments, beam pins 610 may be used in connector 306 in lieu of beam pins 310. Each beam pin 610 may comprise an electrically-conductive material (e.g., aluminum, copper, silver, gold, or other metal) comprising a beam 616 extending from a housing (e.g., housing 308), beam 616 terminated with a hemispheroidal stub 618. Beam pin 610 may be identical or similar to beam pin 310 of FIGS. 3A-3C in many respects, with the exception that the convexity of hemispheroidal stub 618 is the opposite of that of the convexity of hemispheroidal stub 318 of beam pin 310. When a connector housing beam pin 504 is engaged with connector housing beam pin 610, the convex surface of spheroidal stub 514 may be in physical contact with the concave surface of hemispheroidal stub 618, thus providing electrical connectivity between beam pin 504 and beam pin 610, as shown in FIG. 6B. The concavity of hemispheroidal stub 618 may also serve as a retention feature for mechanically retaining spheroidal stub 514, thus ensuring electrical coupling between beam pins 504 and 610. In addition, as shown in FIG. 6B, the mating surface between spheroidal stub 514 and hemispheroidal stub 618 is relatively large creating a large capacitive coupling that ensures electrical coupling in the event of contamination of components that may otherwise prevent a solid electrical contact if such contact surface were smaller.

Figure 2A:
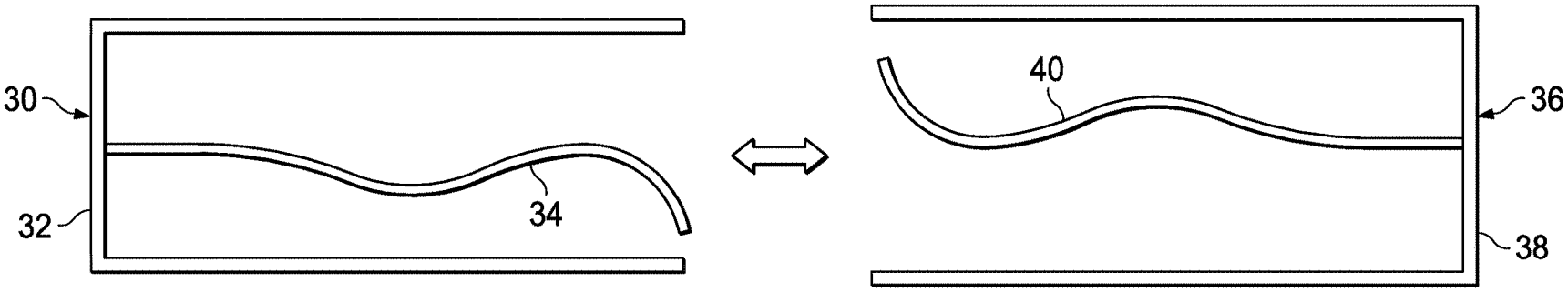
FIG. 2A (PRIOR ART)
FIGS. 2A and 2B each illustrate a cross-sectional elevation view of selected components of connectors for use in a mating beam architecture, as is known in the art.
Figure 2B:
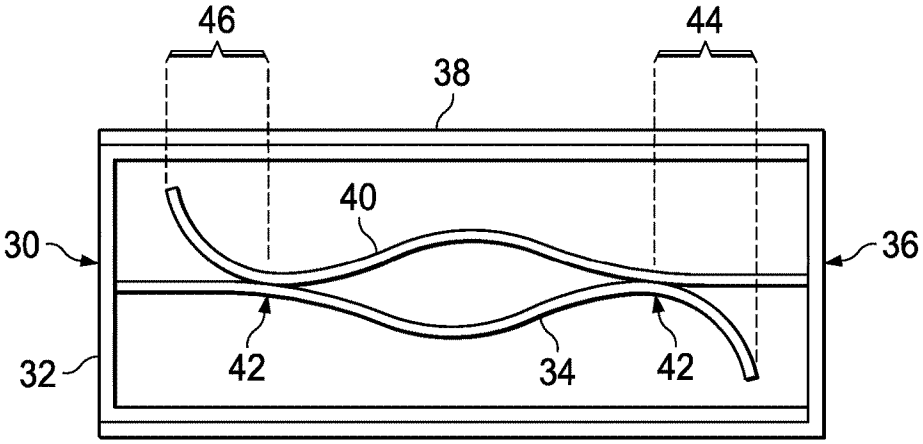
FIG. 2B (PRIOR ART)
Figure 7A:
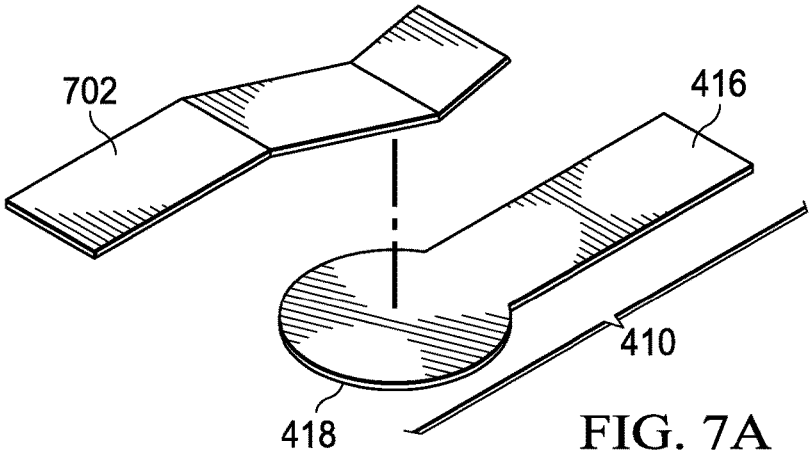
FIGS. 7A and 7B each illustrate an isometric view of selected components of corresponding mating beam-type connectors depicting a standard beam pin and a beam pin with an elliptical stub, in accordance with embodiments of the present disclosure.
Figure 7B:
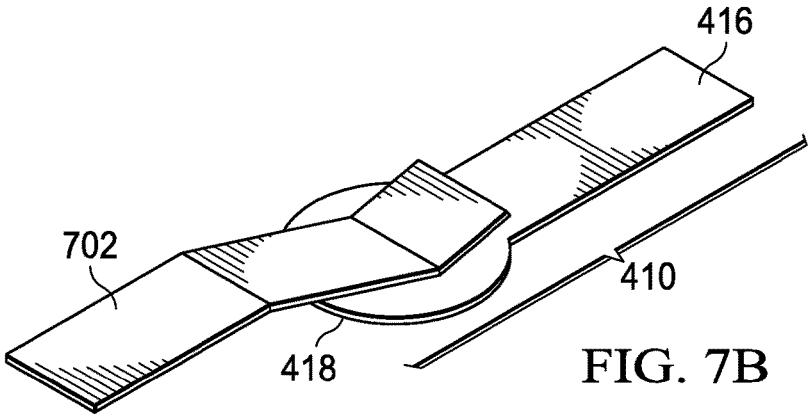

FIGS. 7A and 7B each illustrate an isometric view of selected components of corresponding mating beam-type connectors depicting a standard beam pin 702 (e.g., as depicted in FIGS. 2A and 2B) and a beam pin 410 with an elliptical stub 418 (e.g., as shown in FIGS. 4A and 4B), in accordance with embodiments of the present disclosure. When a connector housing beam pin 702 is engaged with connector housing beam pin 410, a surface of beam pin 702 may be in physical contact with a surface of elliptical stub 418, thus providing electrical connectivity between beam pin 702 and beam pin 410, as shown in FIG. 7B.

In the foregoing discussion, for the purposes of clarity and exposition, various stubs were referred to as being "hemispheroidal." However, in some embodiments of the present disclosure, stubs referred to herein as being "hemispheroidal" may be substituted with stubs formed with a portion of a hemispheroid (e.g., a portion of a spheroid smaller than a hemispheroid, but still having substantial convexity or concavity.

In addition, in the foregoing discussion, for the purposes of clarity and exposition, various stubs were referred to as being "spheroidal." However, in some embodiments of the present disclosure, stubs referred to herein as being "spheroidal" may be substituted with stubs formed with a portion of a spheroid (e.g., a portion of a spheroid smaller than a spheroid, but still having a shape similar to that of a spheroid.

Further, in the foregoing discussion, for the purposes of clarity and exposition, various stubs were referred to as being "elliptical." However, in some embodiments of the present disclosure, stubs referred to herein as being "elliptical" may be substituted with polygonal stubs that share a dimension (e.g., height) with their corresponding beams while being larger in size with respect to at least one other dimension (e.g., width) of the corresponding beams.

The various types of stubs introduced herein (e.g., spheroidal, hemispheroidal, elliptical, and polygonal) may have a per-unit-length surface area greater than that of their corresponding beams. The use of such stub shapes may allow a signal to propagate much faster than that of stubs presently known in the art, as the charge may spread due to a larger area due to the shapes of the stubs introduced herein. Accordingly, the resonance frequencies of beam pins having such improved stubs may be higher than that of beam pins presently known in the art, which may allow for signal communication through pins at greater bandwidths.

In addition, by using a spheroidal or hemispheroidal stub, a diameter of the stub may typically be much smaller than the length of the conventional secondary stub in order to achieve the same mechanical reliability. A stub spheroidal or hemispheroidal in shape may make better contact compared to existing approaches due to the increased surface area incident to such shapes thus reducing swipe length significantly compared to conventional connectors.

Thus, connectors employing improved stubs as described herein may still provide greater mechanical rigidity and tolerance as compared to existing approaches, while also increasing resonance frequencies as compared to existing approaches.

Figure 8:
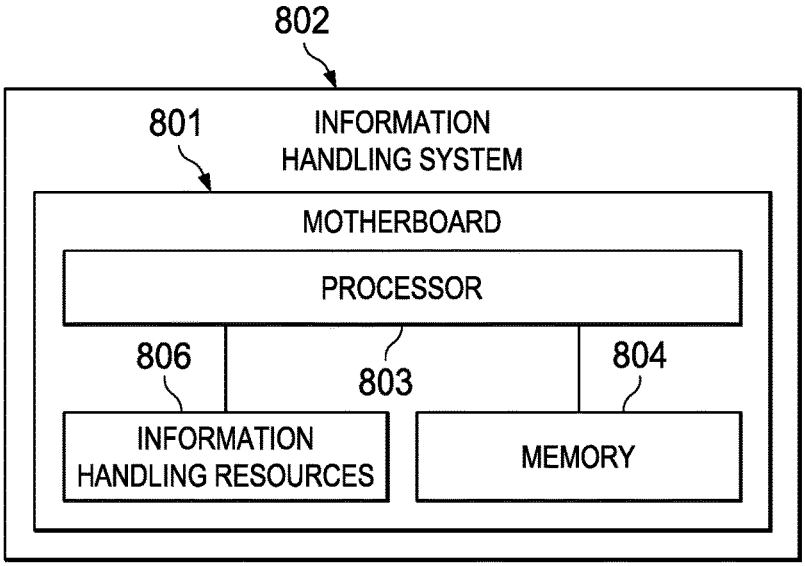
FIG. 8 illustrates a block diagram of an example information handling system, in accordance with certain embodiments of the present disclosure.

FIG. 8 illustrates a block diagram of an example information handling system 802, in accordance with certain embodiments of the present disclosure. As depicted in FIG. 8, information handling system 802 may include a motherboard 801 having a processor 803, a memory 804, and information handling resources 806 coupled thereto.

Motherboard 801 may include a circuit board configured to provide structural support for one or more information handling resources of information handling system 802 and/or electrically couple one or more of such information handling resources to each other and/or to other electric or electronic components external to information handling system 802. In some embodiments, motherboard 801 may comprise a circuit board having one or more connectors such as those connectors disclosed herein.

Processor 803 may be mounted to motherboard 801 and may include any system, device, or apparatus configured to interpret and/or execute program instructions and/or process data, and may include, without limitation, a microprocessor, microcontroller, digital signal processor (DSP), application specific integrated circuit (ASIC), or any other digital or analog circuitry configured to interpret and/or execute program instructions and/or process data. In some embodiments, processor 803 may interpret and/or execute program instructions and/or process data stored in memory 804 and/or another information handling resource of information handling system 802.

Memory 804 may be communicatively coupled to processor 803 via motherboard 801 and may include any system, device, or apparatus configured to retain program instructions and/or data for a period of time (e.g., computer-readable media). Memory 804 may include RAM, EEPROM, a PCMCIA card, flash memory, magnetic storage, opto-magnetic storage, or any suitable selection and/or array of volatile or nonvolatile memory that retains data after power to information handling system 802 is turned off. In some embodiments, memory 804 may comprise one or more memory modules implemented using a circuit board having one or more connectors such as those connectors disclosed herein.

Information handling resources 806 may comprise any component systems, devices or apparatuses of information handling system 802, including without limitation processors, buses, memories, I/O devices and/or interfaces, storage resources, network interfaces, motherboards, integrated circuit packages, electro-mechanical devices, displays, and power supplies. In some embodiments, one or more information handling resources 806 may comprise one or more circuit boards having one or more connectors such as those connectors disclosed herein.

In addition, various information handling resources of information handling system 802 may be coupled via cables or other electronic conduits having one or more connectors such as those connectors disclosed herein.

As used herein, when two or more elements are referred to as "coupled" to one another, such term indicates that such two or more elements are in electronic communication or mechanical communication, as applicable, whether connected indirectly or directly, with or without intervening elements.

This disclosure encompasses all changes, substitutions, variations, alterations, and modifications to the example embodiments herein that a person having ordinary skill in the art would comprehend. Similarly, where appropriate, the appended claims encompass all changes, substitutions, variations, alterations, and modifications to the example embodiments herein that a person having ordinary skill in the art would comprehend. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

All examples and conditional language recited herein are intended for pedagogical objects to aid the reader in understanding the disclosure and the concepts contributed by the inventor to furthering the art, and are construed as being without limitation to such specifically recited examples and conditions. Although embodiments of the present disclosure have been described in detail, it should be understood that various changes, substitutions, and alterations could be made hereto without departing from the spirit and scope of the disclosure.

What is claimed is:

1. A connector comprising:

a housing; and an electrically-conductive pin housed in the housing and configured to electrically couple to a corresponding electrically-conductive conduit, the pin comprising:

a beam extending from the housing; and a single stub terminating the pin, the stub having a shape comprising a single hemispheroid, wherein the stub is formed with respect to the housing such that a concave surface of the hemispheroid is configured to physically contact a corresponding pin of a corresponding connector when the corresponding connector is engaged with the connector, wherein the corresponding pin has a shape comprising a spheroid or a portion thereof.

2. The connector of claim 1, wherein the stub shares a common dimension with the beam, and is larger in size than the beam with respect to at least one other dimension.

3. The connector of claim 1, wherein the corresponding pin has a shape comprising a spheroid.

4. The connector of claim 1, wherein the corresponding pin has a shape comprising a hemispheroid.

5. An information handling system, comprising:

an information handling resource; and a connector coupled to the information handling resource and comprising:

a housing; and an electrically-conductive pin housed in the housing and configured to electrically couple to a corresponding electrically-conductive conduit, the pin comprising:

a beam extending from the housing; and a single stub terminating the pin, the stub having a shape comprising a single hemispheroid, wherein the stub is formed with respect to the housing such that a concave surface of the hemispheroid is configured to physically contact a corresponding pin of a corresponding connector when the corresponding connector is engaged with the connector, wherein the corresponding pin has a shape comprising a spheroid or a portion thereof.

6. The information handling system of claim 5, wherein the stub shares a common dimension with the beam, and is larger in size than the beam with respect to at least one other dimension.

7. The information handling system of claim 5, wherein the corresponding pin has a shape comprising a spheroid.

8. The information handling system of claim 5, wherein the corresponding pin has a shape comprising a hemispheroid.

9. A method for forming an electrically-conductive pin for a connector, comprising:

providing a beam of the pin; and terminating the beam with a single stub having a shape comprising a single hemispheroid; and coupling the pin to a housing for housing the pin such that a concave surface of the hemispheroid is configured to physically contact a corresponding pin of a corresponding connector when the corresponding connector is engaged with the connector, wherein the corresponding pin has a shape comprising a spheroid or a portion thereof.

10. The method of claim 9, wherein the stub shares a common dimension with the beam, and is larger in size than the beam with respect to at least one other dimension.

11. The method of claim 9, wherein the corresponding pin has a shape comprising a spheroid.

12. The method of claim 9, wherein the corresponding pin has a shape comprising a hemispheroid.

* * * * *